US011254146B2

(12) United States Patent
Nagase et al.

(10) Patent No.: US 11,254,146 B2
(45) Date of Patent: Feb. 22, 2022

(54) PRINTING APPARATUS, CONTROL METHOD OF PRINTING APPARATUS, AND STORAGE MEDIUM

(71) Applicant: CANON KABUSHIKI KAISHA, Tokyo (JP)

(72) Inventors: Tomoyuki Nagase, Yokohama (JP); Takeshi Koda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/831,859

(22) Filed: Mar. 27, 2020

(65) Prior Publication Data

US 2020/0307268 A1 Oct. 1, 2020

(30) Foreign Application Priority Data

Mar. 29, 2019 (JP) ..... JP2019-065728

(51) Int. Cl.
*B41J 11/66* (2006.01)
*B41J 13/00* (2006.01)
*B41J 11/42* (2006.01)

(52) U.S. Cl.
CPC ..... *B41J 11/663* (2013.01); *B41J 11/42* (2013.01); *B41J 13/0009* (2013.01)

(58) Field of Classification Search
CPC ..... B41J 11/663; B41J 2/16511; B41J 2/01
See application file for complete search history.

(56) References Cited

U.S. PATENT DOCUMENTS

2014/0132666 A1* 5/2014 Elferink ..... B41J 2/16511 347/30
2016/0313686 A1* 10/2016 Tamura ..... G03G 15/6573

FOREIGN PATENT DOCUMENTS

JP 2017-013438 A 1/2017

* cited by examiner

*Primary Examiner* — Lam S Nguyen
(74) *Attorney, Agent, or Firm* — Venable LLP

(57) ABSTRACT

The present invention relates to a printing apparatus including: a conveyance roller; and a slitter unit configured to cut a printing medium, which is conveyed by the conveyance roller, wherein the slitter unit includes a cutting mechanism including an upper movable blade and a lower movable blade, each of which is in a round shape, and configured to cut the printing medium at a contact point of the upper movable blade and the lower movable blade, a driving unit configured to rotate the upper movable blade and the lower movable blade, and a control unit configured to control a driving amount of the driving unit, and wherein the control unit controls the driving amount of the driving unit such that a movement speed of the upper movable blade and the lower movable blade passing through the contact point becomes greater than a conveyance speed of the printing medium.

9 Claims, 8 Drawing Sheets

PRINTING APPARATUS, CONTROL METHOD OF PRINTING APPARATUS, AND STORAGE MEDIUM

BACKGROUND OF THE INVENTION

Field of the Invention

The present disclosure relates to a printing apparatus, a control method of a printing apparatus, and a storage medium.

Description of the Related Art

The image printing apparatus disclosed in Japanese Patent Laid-Open No. 2017-013438 includes one cutting device on each of the left and right sides of a printing medium in the width direction, so as to cut the printing medium such that the width of the printed subject is in a given size. This cutting device is referred to as a slitter unit. The slitter unit is movable in the width direction, and a printing medium conveyed by a conveyance roller is cut along the conveyance direction by the slitter unit.

SUMMARY OF THE INVENTION

In Japanese Patent Laid-Open No. 2017-013438, there is a problem that, at a timing where a printing medium enters the slitter unit, the conveyed printing medium is not properly fed into the slitter unit, which results in a conveyance failure of the printing medium.

In view of the above problem, the object of the present disclosure is to make a printing medium be properly fed into a slitter unit, so as to prevent a conveyance failure.

An embodiment of the present invention relates to a printing apparatus including: a conveyance roller configured to convey a printing medium; and a slitter unit configured to cut the printing medium, which is conveyed by the conveyance roller, along a conveyance direction, wherein the slitter unit includes a cutting mechanism including an upper movable blade and a lower movable blade, each of which is in a round shape, and configured to cut the printing medium at a contact point of the upper movable blade and the lower movable blade, a driving unit configured to rotate the upper movable blade and the lower movable blade, and a control unit configured to control a driving amount of the driving unit, and wherein the control unit controls the driving amount of the driving unit such that a movement speed of the upper movable blade and the lower movable blade passing through the contact point becomes greater than a conveyance speed of the printing medium by the conveyance roller.

Further features of the present invention will become apparent from the following description of exemplary embodiments with reference to the attached drawings.

DESCRIPTION OF THE EMBODIMENTS

Hereinafter, an explanation is given of embodiments of the present invention with reference to the drawings. The following embodiments do not limit the present invention. Further, every combination of the characteristics explained in the present embodiments is not necessarily essential to the solution means of the present invention. The same reference sign is assigned for explanation of the identical configuration. In addition, relative positions, shapes, and the like, of the constituent elements described in the embodiments are merely examples and are not intended to limit the present invention to the range of the examples.

In the explanations of the following embodiments, the meaning of "printing" includes, not only a case of forming meaningful information such as a letter or a figure, but also a case of processing a medium or a case of forming an image, a design, a pattern, or the like, on a printing medium in a broad sense regardless of being meaningful or meaningless. The formed object does not have to be actualized in such a manner that a human can visually perceive. Furthermore, although it is assumed that the "printing medium" is a roll sheet in the present embodiments, it is possible that the "printing medium" is a cut sheet, a cloth, a plastic film, or the like.

First Embodiment

<Configuration of Inkjet Printing Apparatus>

Figure 1:
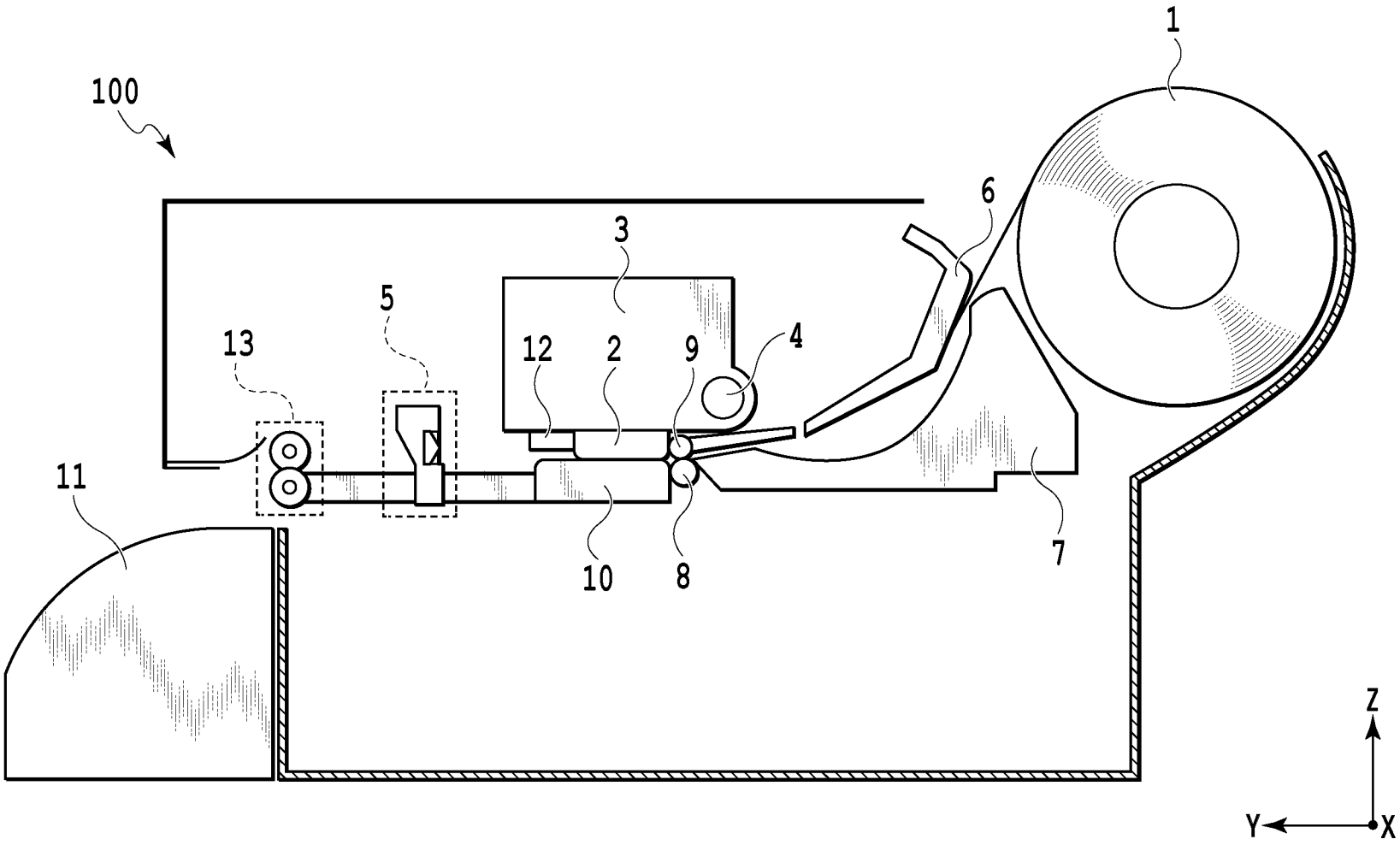
FIG. 1 is a cross-sectional view of an inkjet printing apparatus.

FIG. 1 is a cross-sectional view illustrating an example of an inkjet printing apparatus according to the present embodiment. The inkjet printing apparatus 100 performs printing on a printing medium that has a shape of a long sheet. In the present embodiment, the printing medium is a roll sheet 1. The roll sheet 1 held in the inkjet printing apparatus 100 is conveyed to the downstream through a conveyance path formed by the upper guide 6 and the lower guide 7. The roll sheet 1 is nipped by the conveyance roller 8 and the pinch roller 9 and conveyed to an image printing unit. The image printing unit is configured to include the print head 2, the carriage 3 on which the print head 2 is mounted, and the platen 10 disposed at a position facing the print head 2. The roll sheet 1 is conveyed onto the platen 10 by the conveyance roller 8. Ink is ejected by the print head 2 onto the roll sheet 1 conveyed to the image printing unit, so as to print an image.

The carriage 3 is supported so as to be able to perform a sliding motion along the guide shaft 4 and a guide rail (not illustrated in the drawing) that are disposed in parallel to each other in the inkjet printing apparatus 100. The carriage 3 includes the reflection type detection sensor 12 facing the platen 10, so as to be able to detect the reflectivity of a spot position. That is, in a case where the platen 10 is black and the roll sheet 1 is white, the reflectivity of the platen 10 and the roll sheet 1 are greatly different. Therefore, it is possible to determine whether the platen 10 is present or the roll sheet 1 is present at the spot position by use of the detection sensor 12. It is possible to detect the leading edge of the roll sheet 1 by utilizing the fact that, while the roll sheet 1 is conveyed by the conveyance roller 8, the reflectivity greatly changes in a case where the leading edge of the roll sheet 1 in the conveyance direction passes through the spot position of the detection sensor 12.

The carriage 3 scans in the X direction along the guide shaft 4 while holding the print head 2, and the print head 2 ejects ink while the carriage 3 scans, so as to perform printing on the roll sheet 1. After a scan by the carriage 3 to perform printing on the roll sheet 1, the conveyance roller 8 conveys the roll sheet 1 by a predetermined amount, and the carriage 3 scans on the roll sheet 1 again to perform printing. In this way, by repeating printing and conveying, the entire printing is completed.

Furthermore, since the detection sensor 12 is mounted on the carriage 3, the positions of the paper edges in the width direction (X direction) of the roll sheet 1 can also be detected by the reciprocating operation of the carriage 3.

On the downstream side relative to the carriage 3 in the conveyance direction of the roll sheet 1, there is provided the cutter 5 for cutting the roll sheet 1 in a direction intersecting the conveyance direction, and, on the further downstream side, there is provided the slitter 13 for cutting the roll sheet 1 along the conveyance direction. On the downstream side relative to the slitter 13, there is provided the discharging guide 11 for discharging the roll sheet 1 that is cut.

The cutter 5 includes a cutter unit 300 as a cutting mechanism for cutting the roll sheet 1 and a unit for moving the cutter unit 300 along the X direction. Furthermore, the slitter 13 includes a slitter unit 303 as a cutting mechanism for cutting the roll sheet 1 and a unit for moving the slitter unit 303 along the X direction.

<Cutter and Slitter>

Figure 2:
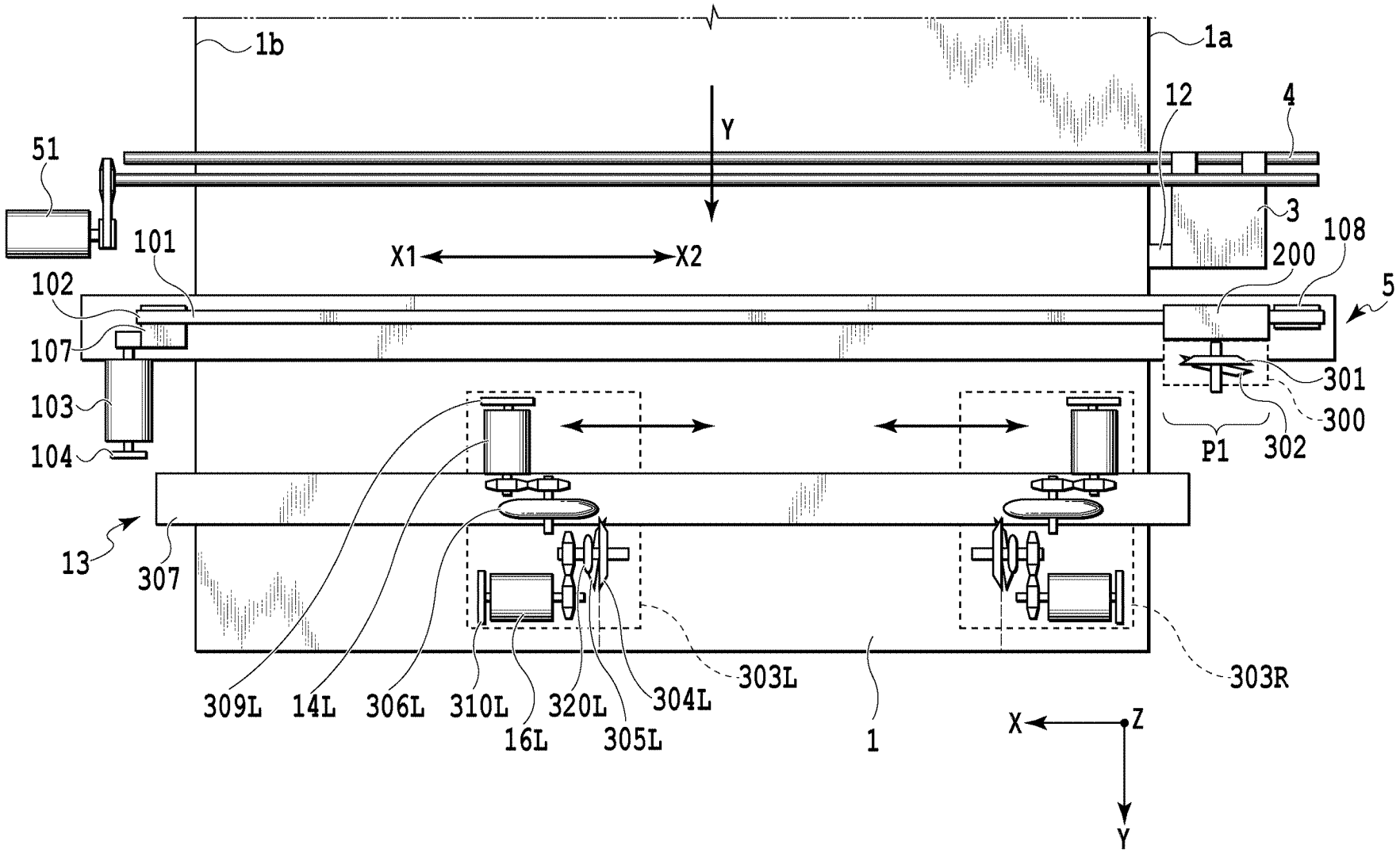
FIG. 2 is a top view illustrating a conveyance path of a sheet in the inkjet printing apparatus.

FIG. 2 is a top view for explaining the cutter 5 and the slitter 13 including the slitter units 303L and 303R. In the present specification, "L" and "R" at the end of the reference signs indicate a member on the left side (that is, +X side) and a member on the right side (that is, −X side) on the drawings, respectively. In the present specification, such an end of a reference sign may be omitted in a case of members that are the same on the left side and the right side.

The guide rail 101 is configured to guide the cutter carriage 200 in the direction intersecting the conveyance direction of the roll sheet 1. The cutter carriage 200 integrally connects the cutter unit 300 and the belt 102. Furthermore, the belt 102 is configured to bridge the motor pulley 107 and the tensioner pulley 108 disposed on the left and right sides of the guide rail 101 and is configured to be moved by the cutter motor 103 connected to the motor pulley 107. The cutter motor 103 is provided with the cutter encoder 104. The cutter encoder 104 counts the number of pulses corresponding to driving of the cutter motor 103. Based on the origin position of the cutter carriage 200 and the number of pulses obtained by the cutter encoder 104, it is possible to control the movement position of the cutter unit 300 in the X1 and X2 directions.

The cutter unit 300 includes the upper movable blade 301 and the lower movable blade 302, each which is in a round shape, so that the roll sheet 1 is cut at the contact point of the upper movable blade 301 and the lower movable blade 302 while the cutter unit 300 moves in the X1 direction. Furthermore, the upper movable blade 301 and the lower movable blade 302 are connected to the cutter motor 103 via the belt 102 and the cutter carriage 200 and are configured to be rotationally driven. In a case where the roll sheet 1 is cut, the roll sheet 1 is cut while the lower movable blade 302 and the upper movable blade 301, which is in contact with the lower movable blade 302, rotate together. In the example of FIG. 2, the cutter unit 300 performs cutting from the first end 1*a* of a roll sheet to the second end 1*b* of the roll sheet. The first end 1*a* of a roll sheet is an end on the stand-by position P1 side of the cutter unit 300. After the roll sheet 1 is cut, the cutter carriage 200 is reversed at a predetermined reversing position. Further, the cutter carriage 200 moves to a position that is the stand-by position P1 to stand by for the next cutting operation. Although the cutter unit 300 is mounted on the cutter carriage 200 in the example of the present embodiment, the cutter unit 300 may be mounted on the carriage 3 that moves the print head 2, etc., for example.

The slitter 13 is disposed on the downstream side relative to the cutter 5 in the conveyance direction of the roll sheet 1. A slitter unit 303 of the slitter 13 is able to move to a given position in the X1 and X2 directions and is able to cut the roll sheet 1 along the direction parallel to the conveyance direction (+Y direction). In the present embodiment, an explanation is given of a configuration in which two slitter units 303 are mounted. That is, an explanation is given of the example in which the slitter unit 303L and the slitter unit 303R are mounted. The slitter units 303L and 303R have the same configuration with the components that are left-right reversals in the X1 and X2 directions. In FIG. 2, for the sake of simplification, reference signs are mainly assigned to the components of the slitter unit 303L.

Figure 3A:
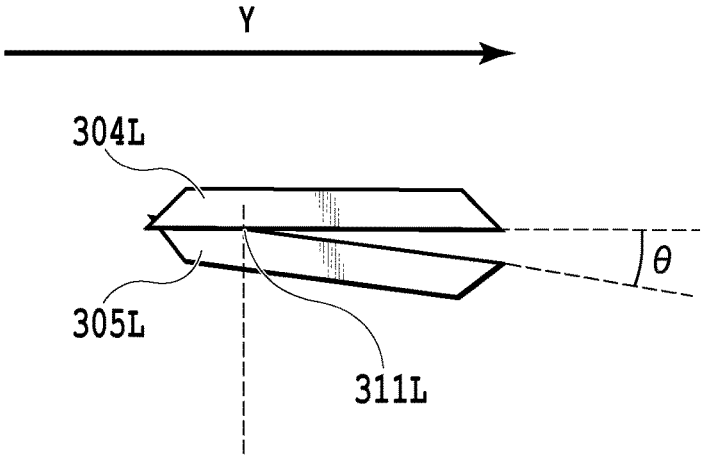
FIGS. 3A and 3B are diagrams illustrating a schematic configuration of a slitter unit.
Figure 3B:
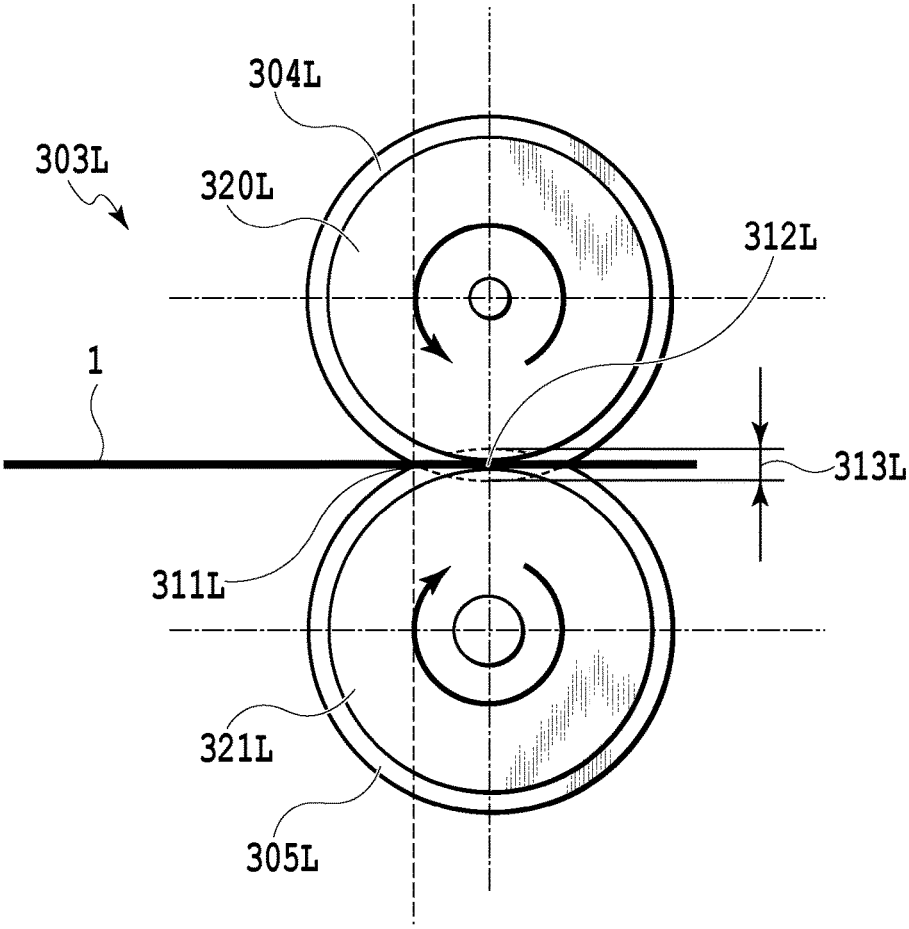
Figure 4:
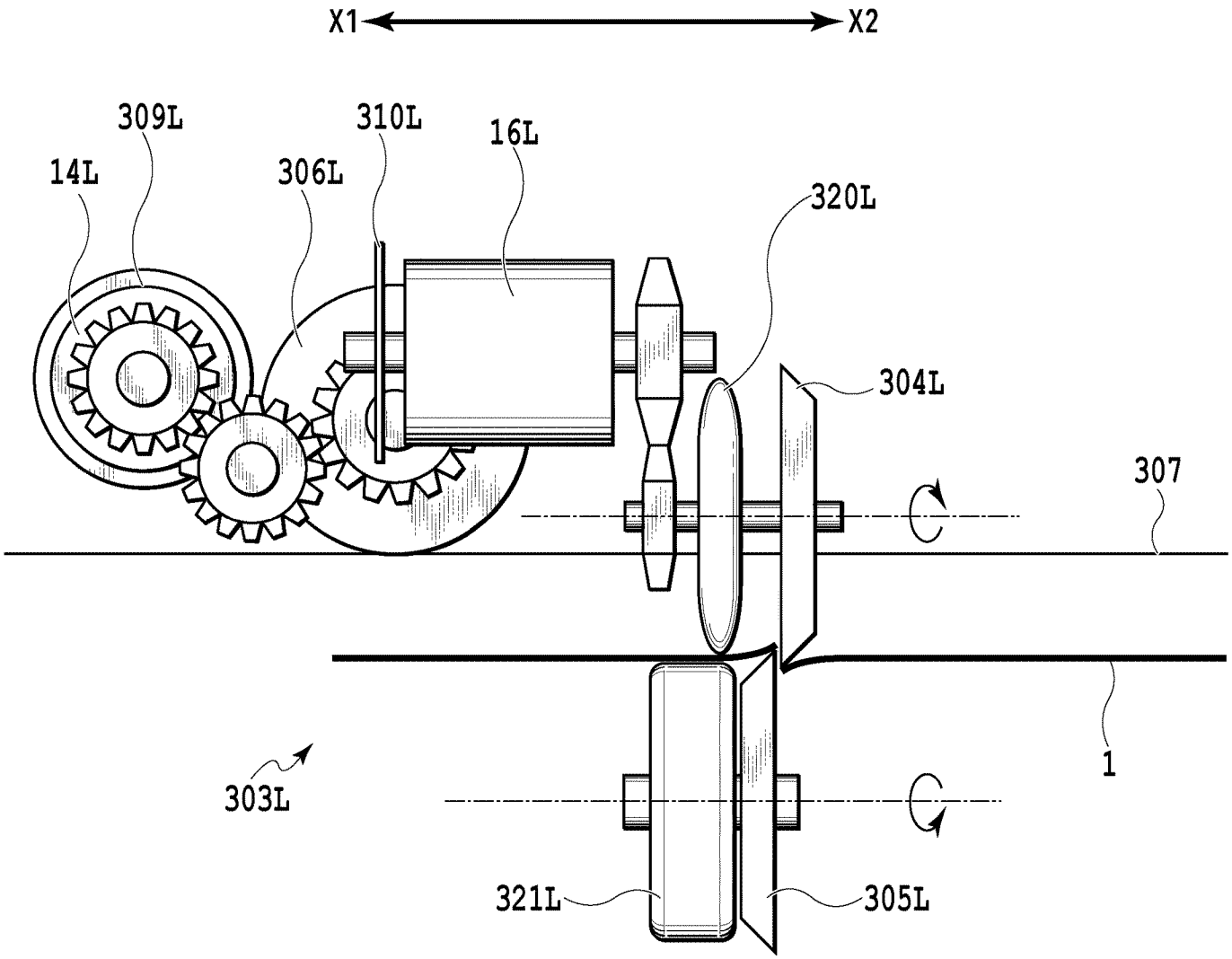
FIG. 4 is a front view of the slitter unit.

FIGS. 3A and 3B and FIG. 4 are diagrams for explaining details of the slitter unit 303L. FIG. 3A is a schematic top view of the slitter unit 303L, and FIG. 3B is a schematic side view of the slitter unit 303L. The slitter unit 303L includes the slitter upper movable blade 304L and the slitter lower movable blade 305L. The slitter upper movable blade 304L and the slitter lower movable blade 305L are disposed so as to have a round blades overlap amount 313L in the vertical direction and have a predetermined amount of angle (intersect angle) θ relative to the conveyance direction Y, which is the cutting direction. The roll sheet 1 is cut at the contact point 311L of the slitter upper movable blade 304L and the slitter lower movable blade 305L. The slitter upper movable blade 304L is connected to the slitter driving motor 16L via a gear.

The slitter unit 303L includes the slitter upper movable blade 304L and the slitter lower movable blade 305L, each of which is in a round shape, so that the roll sheet 1 is cut at the contact point of the slitter upper movable blade 304L and the slitter lower movable blade 305L. More specifically, in a case where the conveyed roll sheet 1 enters the contact point of the slitter upper movable blade 304L and the slitter lower movable blade 305L, the roll sheet 1 is cut along the Y direction by the slitter upper movable blade 304L and the slitter lower movable blade 305L that are rotating while the roll sheet 1 moves in the Y direction. In the present specification, the point where a medium makes contact with blades to be cut is expressed as a "contact point". The roll sheet 1 is cut at the contact point of the slitter upper movable blade 304L and the slitter lower movable blade 305L. In addition, the speed of an upper movable blade and a lower movable blade passing through the contact point by rotational driving is expressed as "the movement speed of blades at the contact point".

In a case where the slitter upper movable blade 304L is rotated by the driving force of the slitter driving motor 16L, the slitter upper conveyance roller 320L, which is connected coaxially with the slitter upper movable blade 304L, rotates as well. The outer diameter of the slitter upper conveyance roller 320L is in contact with the outer diameter of the slitter lower conveyance roller 321L, which is connected coaxially with the slitter lower movable blade 305L, at the roller nip point 312L. Thus, by driving with friction transmission, while the roll sheet 1 is conveyed by the slitter upper conveyance roller 320L and the slitter lower conveyance roller 321L, the upper and lower blades rotate together to cut the roll sheet 1 in the conveyance direction. Since the slitter driving motor 16L is provided with the slitter driving encoder 310L, it is possible to control the slitter driving motor 16L with a predetermined rotation speed and a predetermined rotation amount. The slitter driving motor 16L is controlled to drive at a driving amount (specifically, a rotation speed and a rotation amount), which is synchronized with and corresponding to the conveyance amount by the conveyance roller 8.

The slitter unit 303L includes the slitter moving motor 14L and is configured such that driving force is transmitted to the slitter moving roller 306L via a gear. The slitter moving roller 306L abuts on the slitter guide rail 307, and the slitter unit 303L is configured to be movable in the X1 and X2 directions by friction between the front surface of the slitter moving roller 306L and the slitter guide rail 307. In other words, the slitter upper movable blade 304L, the slitter lower movable blade 305L, the slitter upper conveyance roller 320L, and the slitter lower conveyance roller 321L are integrally movable along the slitter guide rail 307.

Although the slitter moving roller 306L is driven with friction in the present embodiment, the slitter moving roller 306L may have a rack and pinion configuration with a slitter moving roller serving as a pinion and a slitter guide rail serving as a rack.

Next, an explanation is given of general operation of cutting by the slitter units 303. First, the slitter units 303L and 303R are moved to cutting positions, and the roll sheet 1 is conveyed by the conveyance roller 8 while the conveyance motor 51 and the slitter driving motors 16L and 16R are driven. Thereafter, in a case where the leading edge of the roll sheet 1 reaches the contact points 311L and 311R of the slitter 13, the roll sheet 1 is cut by the slitter upper movable blades 304L and 304R and the slitter lower movable blades 305L and 305R on the left and right sides. Furthermore, the roll sheet 1 is nipped and conveyed by the slitter upper conveyance rollers 320L and 320R and the slitter lower conveyance rollers 321L and 321R on the left and right sides while being cut, so as to be discharged through the discharging guide 11.

Additionally, cutting by the slitter units 303 can be performed together with image printing. The slitter units 303 move from the stand-by positions to predetermined cutting positions in the X1 and X2 directions according to the setting by the user. Then, the roll sheet 1 is conveyed by the conveyance roller 8 while the conveyance motor 51 and the slitter driving motors 16L and 16R are driven. In the image printing unit, in response to forward or return scanning of one line by the carriage 3 for printing an image, the roll sheet 1 is conveyed by the conveyance roller 8 and the pinch roller 9 by a predetermined pitch. Then, the carriage 3 is moved again to perform image printing of the next line. In a case where printing proceeds and the leading edge of the roll sheet 1 reaches the contact points 311, the roll sheet 1 is cut by the slitter upper movable blades 304L and 304R and the slitter lower movable blades 305L and 305R that are rotating. Furthermore, the roll sheet 1 is nipped and conveyed by the slitter upper conveyance rollers 320L and 320R and the slitter lower conveyance rollers 321L and 321R while being cut. Then, the image printing ends and the cutting by the slitter units 303 ends. Subsequently, the slitter units 303 move to the predetermined stand-by positions. The roll sheet 1 is conveyed up to a cutting position where the cutter unit 300 can cut the roll sheet 1, then the roll sheet 1 is cut by the cutter unit 300, so as to be discharged through the discharging guide 11.

The configuration of the slitter 13 described above is merely an example. That is, the slitter 13 may have any configuration as long as the slitter 13 is movable in the width direction of the roll sheet 1 and is able to cut the conveyed roll sheet 1 in the conveyance direction at a given position of the width direction. Further, there may be a mode in which the slitter upper conveyance rollers 320, the slitter lower conveyance rollers 321, the slitter upper movable blades 304, and the slitter lower movable blades 305 are independently driven.

<Control Configuration>

Figure 5:
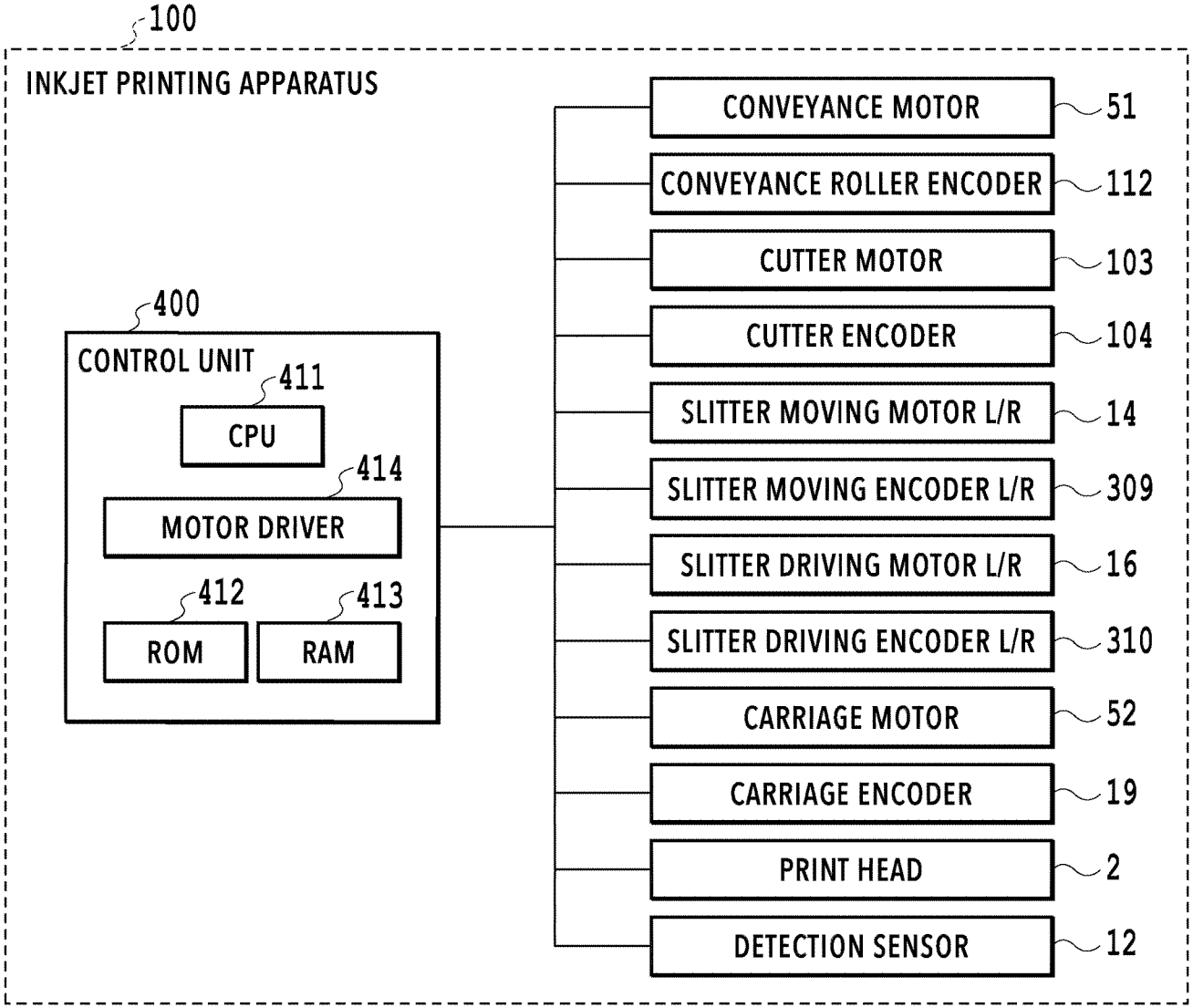
FIG. 5 is a block diagram for explaining a control system of the inkjet printing apparatus.

FIG. 5 is a schematic block diagram illustrating a control configuration of the inkjet printing apparatus 100. The inkjet printing apparatus 100 includes a control unit 400. Furthermore, the control unit 400 includes a CPU 411, a ROM 412, a RAM 413, and a motor driver 414. The control unit 400 implements control of a conveyance motor 51, a cutter motor 103, a slitter moving motor 14, a slitter driving motor 16, a carriage motor 52, and a print head 2. The control unit 400 obtains signals from a conveyance roller encoder 112, a cutter encoder 104, a slitter moving encoder 309, a slitter driving encoder 310, a carriage encoder 19, and a detection sensor 12. Furthermore, the control unit 400 controls the various motors and the print head 2, based on the signals.

<Problem to Be Solved in Present Embodiment>

Figure 6A:
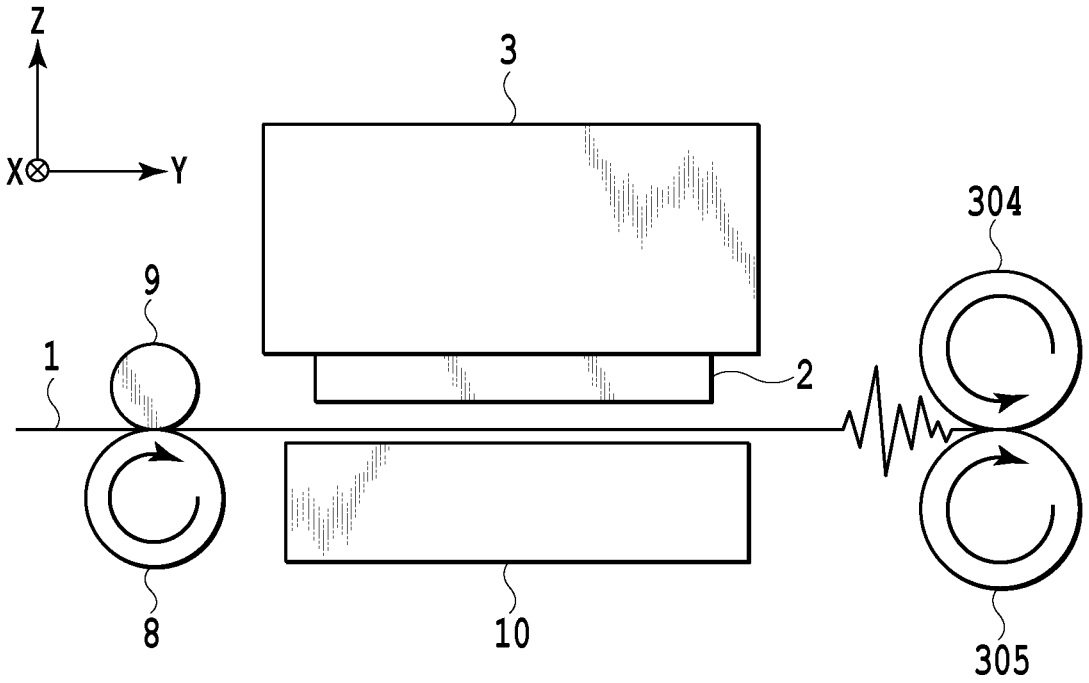
FIGS. 6A and 6B are diagrams for explaining behavior of the slitter unit.

Hereinafter, the problem of the present embodiment is explained with reference to FIG. 6A. As illustrated in FIG. 6A, the roll sheet 1 is conveyed in the +Y direction by the conveyance roller 8 and the pinch roller 9. Here, the conveyance roller 8 is controlled to convey the roll sheet 1 at a predetermined speed. The conveyance speed of the roll sheet 1 in the Y direction by the conveyance roller 8 at this timing is referred to as a conveyance speed A [mm/s]. On the roll sheet 1, an image is printed by the print head 2, which is mounted on the carriage 3. Thereafter, the roll sheet 1 is further conveyed in the +Y direction, and, in a case where the leading edge of the roll sheet 1 reaches the contact points 311, the roll sheet 1 is cut by the slitter upper movable blades 304 and the slitter lower movable blades 305 that are rotating. Furthermore, the roll sheet 1 is nipped and conveyed by the slitter upper conveyance rollers 320 and the slitter lower conveyance rollers 321 while being cut.

Here, it is assumed that the rotation speed of the slitter upper movable blades 304 and the slitter lower movable blades 305 is equal to the rotation speed corresponding to the conveyance speed A of the roll sheet 1 by the conveyance roller 8. In other words, it is assumed that the conveyance speed A [mm/s] of the roll sheet 1 in the Y direction by the conveyance roller 8 is equal to the movement speed [mm/s] of the slitter upper movable blades 304 and the slitter lower movable blades 305 at the contact points 311. In such a case as described above, in a case where there is a timing error at a timing where the leading edge of the roll sheet 1 enters the slitter units 303, the roll sheet 1 buckles before being cut, as illustrated in the drawing. As a result, a conveyance failure such as paper jam occurs.

Therefore, in the present embodiment, at a timing where the leading edge of the roll sheet 1 enters the slitter units 303, the movement speed of the slitter upper movable blades 304 and the slitter lower movable blades 305 at the contact points 311 is controlled to become faster than the conveyance speed of the roll sheet 1 in the Y direction by the conveyance roller 8.

<Conveyance Control>

Figure 7:
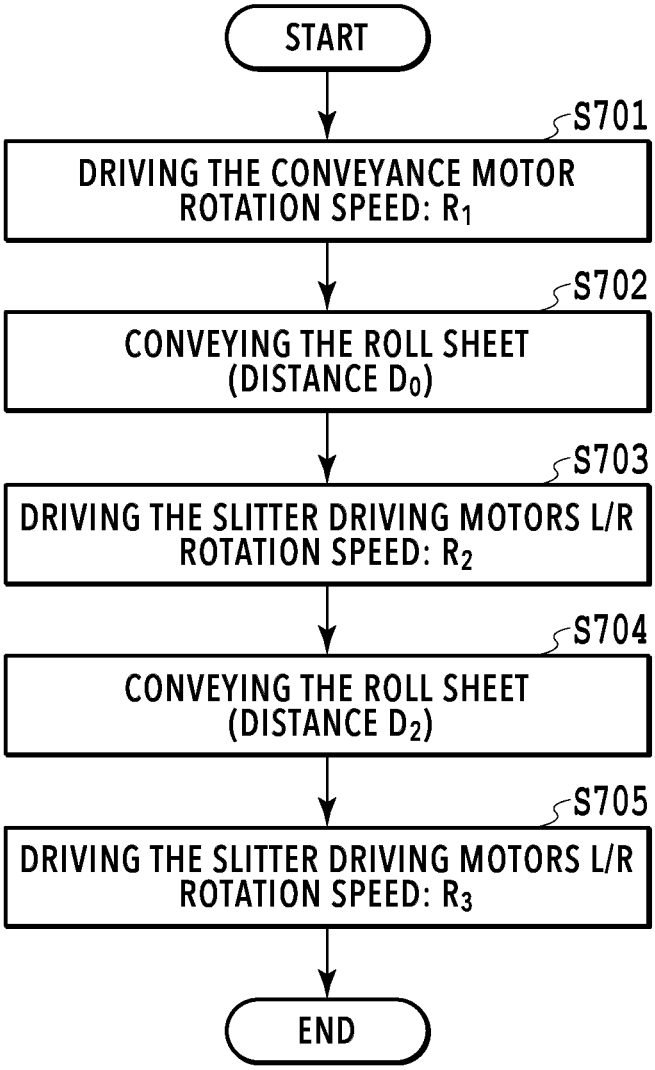
FIG. 7 is a flowchart of conveyance control processing.

Hereinafter, the conveyance control according to the present embodiment is explained with reference to FIG. 7. FIG. 7 is a flowchart of the conveyance control processing in the present embodiment.

In Step S701, the CPU 411 drives the conveyance motor 51 at a predetermined rotation speed ($R_1[s^{-1}]$). The rotation speed $R_1$ is a rotation speed corresponding to the above-described conveyance speed A [mm/s] of the roll sheet 1 in the Y direction. In the following, "Step S . . . " is simply abbreviated as "S . . . ".

Figure 8:
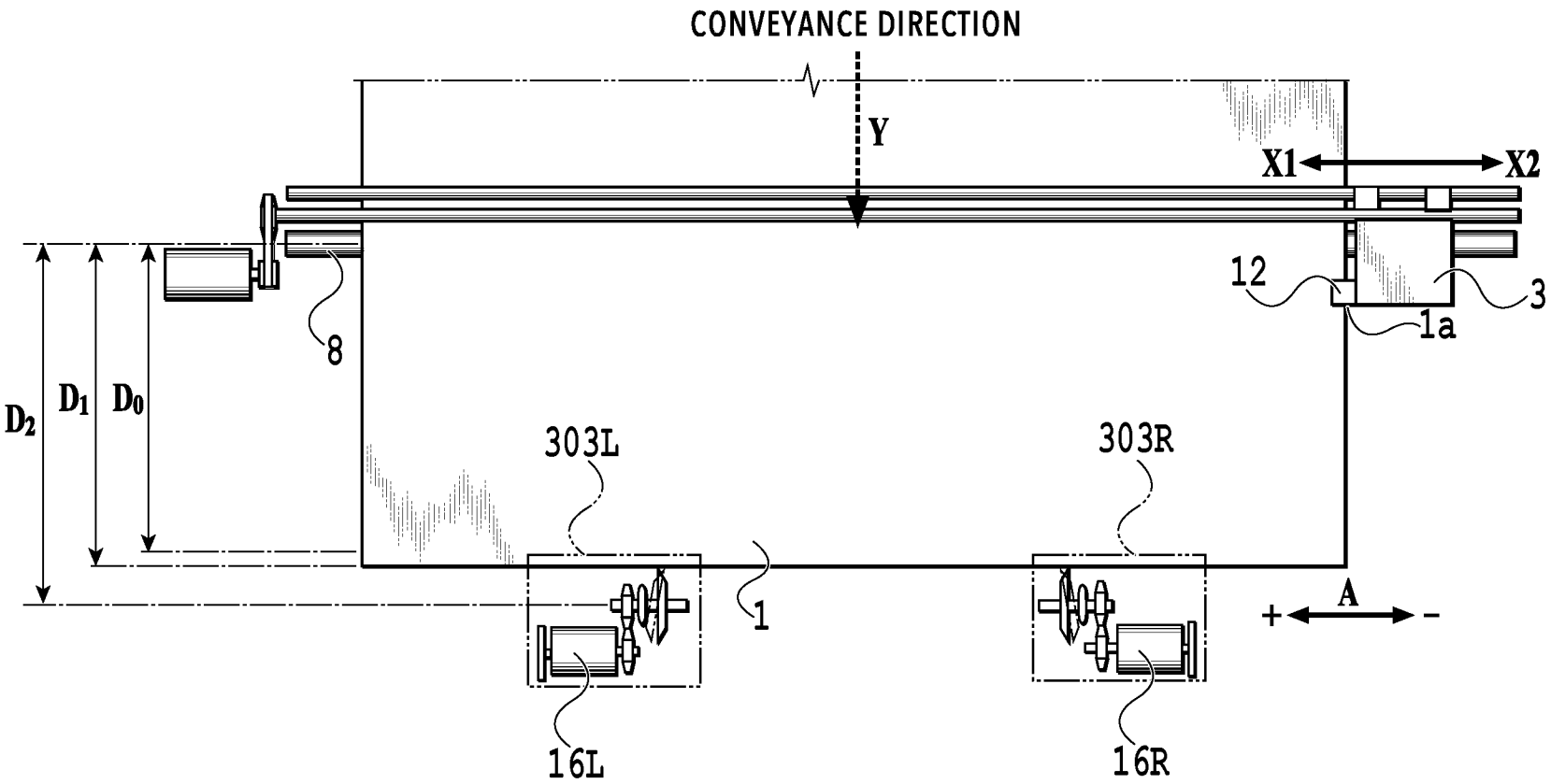
FIG. 8 is a diagram for explaining the conveyance control processing.

In S702, the CPU 411 conveys the roll sheet 1 until the distance between the conveyance roller 8 and the leading edge of the roll sheet 1 that has passed through the position of the conveyance roller 8 becomes a predetermined distance ($D_0$) (see FIG. 8). As the distance $D_0$ to which the roll sheet 1 is conveyed in this step, a given value that is equal to or smaller than the distance $D_1$, which is the distance between the conveyance roller 8 and the slitter units 303 in the Y direction, may be used (see FIG. 8).

In S703, the CPU 411 drives the slitter driving motors 16 at a predetermined rotation speed ($R_2$). The rotation speed $R_2$ is a rotation speed corresponding to the movement speed B [mm/s] of the slitter upper movable blades 304 and the slitter lower movable blades 305 at the contact points 311. Note that the movement speed B satisfies the following formula (1).

$$\text{MOVEMENT SPEED B} > \text{CONVEYANCE SPEED A} \qquad \text{formula (1)}$$

Here, it is assumed that the movement speed B is 101% of the conveyance speed A. Note that the value of the movement speed B is not limited to 101% of the conveyance speed A and may be approximately 101% of the conveyance speed A. As described above, in the present embodiment, at a timing where the roll sheet 1 enters the slitter units 303, rotation of the slitter upper movable blades 304 and the slitter lower movable blades 305 is controlled such that the movement speed of the slitter upper movable blades 304 and the slitter lower movable blades 305 at the contact points 311 is greater than the conveyance speed of the roll sheet 1.

In S704, the CPU 411 conveys the roll sheet 1 until the distance between the conveyance roller 8 and the leading edge of the roll sheet 1 that has passed through the position of the conveyance roller 8 becomes a predetermined distance ($D_2$) (see FIG. 8). Note that the distance $D_2$ satisfies the following formula (2).

$$D_2 = D_1 + \mathrm{RA} \qquad \text{formula (2)}$$

RA in the formula (2) indicates the radius of the slitter upper movable blades 304 and the slitter lower movable blades 305. The value added to $D_1$ in the formula (2) is not limited to RA and may be any value with a magnitude that is approximately equal to RA.

In S705, the CPU 411 drives the slitter driving motors 16 at a predetermined rotation speed ($R_3$) (note that $R_3 < R_2$).

In this step, the rotational speed of the slitter upper movable blades 304 and the slitter lower movable blades 305 is decreased. However, since the roll sheet 1 has already been fed into the slitter units 303 at this point, the possibility that a conveyance failure occurs is low.

The above is the contents of the conveyance control in the present embodiment.

<Effect of Present Embodiment>

Figure 6B:
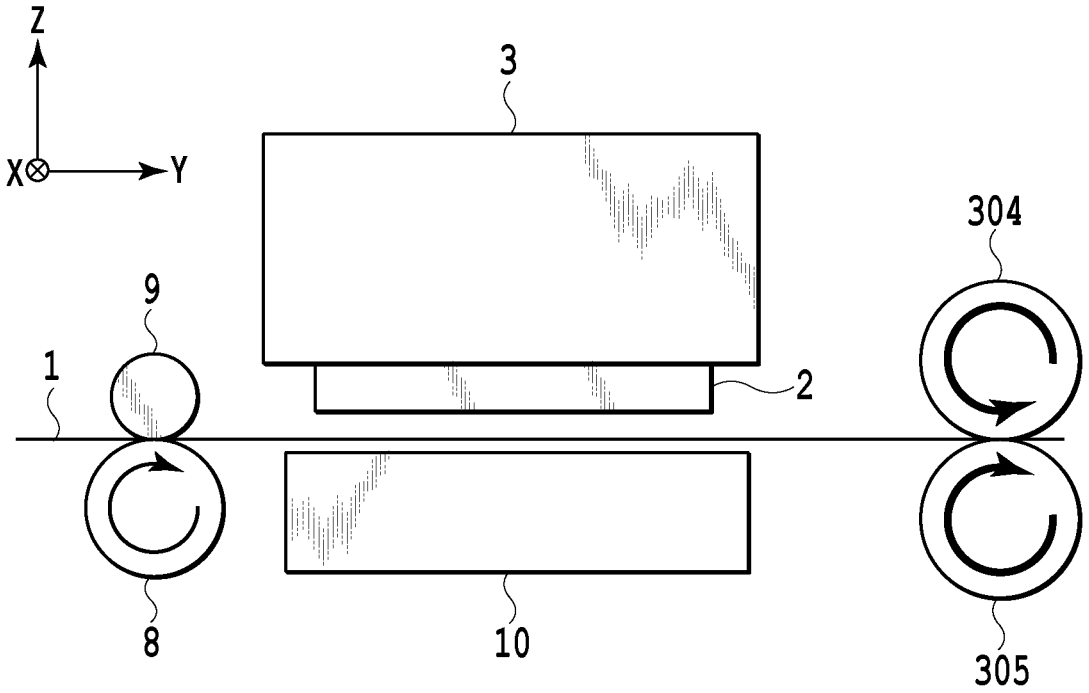

FIG. 6B is a diagram illustrating the effect of the present embodiment. As described above, in the present embodiment, at a timing where the roll sheet 1 enters the slitter units 303, the movement speed of the slitter upper movable blades 304 and the slitter lower movable blades 305 at the contact points 311 is controlled to become greater than the conveyance speed of the roll sheet 1 in S703. Accordingly, it is possible to prevent the roll sheet 1 from buckling before being cut.

Other Embodiments

In the above-described embodiments, the explanations have been given with the example of a printing apparatus in which the carriage 3 scans in the X direction while holding the print head 2, so as to perform printing operation. However, there may be a mode in which a print head that is provided with ejection openings corresponding to the size of the printing medium in the width direction, which may be termed as a line-type print head, is used. Furthermore, the above-described embodiments may be used in combination, as appropriate.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

According to the present disclosure, it is possible to make a printing medium be properly fed into a slitter unit, so as to prevent a conveyance failure.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-065728, filed Mar. 29, 2019, which is hereby incorporated by reference wherein herein in its entirety.

What is claimed is:

1. A printing apparatus comprising:

a conveyance roller configured to convey a printing medium;

a slitter unit comprising an upper blade and a lower blade which are both rotatable, the slitter unit being configured to cut the printing medium, conveyed by the conveyance roller, along a conveyance direction of the printing medium at a contact point between the upper blade and the lower blade;

a driving unit configured to rotate the upper blade; and a control unit configured to control a movement speed at which the upper blade passes the contact point by controlling a driving amount of the driving unit, wherein the control unit controls the driving amount of the driving unit such that the movement speed at a timing when a leading edge of the printing medium enters the contact point becomes greater than the movement speed at a timing after the leading edge of the printing medium has passed the contact point.

2. The printing apparatus according to claim 1, wherein each of the upper blade and the lower blade has a round shape, and wherein in a case where the slitter unit has cut the leading edge of the printing medium, which has entered the contact point, by a length that is approximately equal to a radius of the upper blade, the control unit controls the movement speed of the upper blade to become slower.

3. The printing apparatus according to claim 1, wherein the slitter unit is provided on a downstream side relative to the conveyance roller in the conveyance direction.

4. The printing apparatus according to claim 1, wherein the movement speed at a timing where the printing medium enters the contact point is approximately 101% of the conveyance speed.

5. The printing apparatus according to claim 1, further comprising:

a printing unit configured to print an image on the printing medium conveyed by the conveyance roller in a conveyance direction; and a carriage, upon which the printing unit is mounted, the carriage being configured to move the printing unit in a width direction of the printing medium, wherein the slitter unit is arranged downstream in the conveyance direction from the printing unit.

6. A printing apparatus according to claim 5, wherein the control unit alternately performs printing of an image by the printing unit and cutting of the printing medium by the slitter unit while conveying the printing medium by the conveyance roller.

7. The printing apparatus according to claim 1, wherein at a timing where the leading edge of the printing medium enters the contact point, the movement speed is greater than a conveyance speed of the printing medium by the conveyance roller.

8. The printing apparatus according to claim 1, wherein after the leading edge of the printing medium passes through the contact point, the driving unit reduces a rotation speed of the upper blade.

9. A control method of a printing apparatus, the printing apparatus including: (1) a conveyance roller configured to convey a printing medium; (2) a slitter unit comprising an upper blade and a lower blade which are both rotatable, the slitter unit being configured to cut the printing medium, conveyed by the conveyance roller, along a conveyance direction of the printing medium at a contact point between the upper blade and the lower blade; (3) a driving unit configured to rotate the upper blade; and (4) a control unit configured to control a movement speed at which the upper blade passes the contact point by controlling a driving amount of the driving unit, wherein the control method comprises a step in which the control method controls the driving amount of the driving unit such that the movement speed at a timing when a leading edge of the printing medium enters the contact point becomes greater than the movement speed at a timing after the leading edge of the printing medium has passed the contact point.

* * * * *